US006644940B2

(12) United States Patent
Yamada

(10) Patent No.: US 6,644,940 B2
(45) Date of Patent: Nov. 11, 2003

(54) RESTARTING DEVICE FOR A FLUID OPERATED DOUBLE DIAPHRAGM PISTON PUMP

(75) Inventor: Kazumasa Yamada, Tokyo (JP)

(73) Assignee: Yamada Corporation, Tokyo (JP)

( * ) Notice: Subject to any disclaimer, the term of this patent is extended or adjusted under 35 U.S.C. 154(b) by 0 days.

(21) Appl. No.: 10/002,284

(22) Filed: Dec. 5, 2001

(65) Prior Publication Data

US 2002/0076340 A1 Jun. 20, 2002

(30) Foreign Application Priority Data

Dec. 18, 2000 (JP) ..... 2000-383324

(51) Int. Cl.[7] ..... F04B 35/02

(52) U.S. Cl. ..... 417/393; 417/384; 417/534; 417/537; 417/559

(58) Field of Search ..... 417/393, 384, 417/392, 395, 534, 537, 539, 559

(56) References Cited

U.S. PATENT DOCUMENTS 3,741,689 A * 6/1973 Rupp ..... 417/393
4,566,867 A 1/1986 Bazan et al. ..... 417/393
4,674,958 A * 6/1987 Igarashi et al. ..... 417/225
4,854,832 A 8/1989 Gardner et al. ..... 417/393
4,923,168 A 5/1990 Murata et al. ..... 251/75
5,326,234 A * 7/1994 Versaw et al. ..... 417/393
5,551,847 A 9/1996 Gardner et al. ..... 417/393
6,036,445 A * 3/2000 Reynolds ..... 417/53
6,126,403 A 10/2000 Yamada ..... 417/46
6,257,845 B1 * 7/2001 Jack et al. ..... 417/395
6,280,149 B1 * 8/2001 Able et al. ..... 417/63
2001/0016169 A1 8/2001 Budde ..... 417/393

* cited by examiner

*Primary Examiner*—Charles G. Freay
*Assistant Examiner*—Emmanuel Sayoc
(74) *Attorney, Agent, or Firm*—Wenderoth, Lind & Ponack, L.L.P.

(57) ABSTRACT

A restarting device of a pump including a center rod defining fluid delivering chambers and driving chambers 11*b* and 12*b*. The restarting device of the pump further includes: a change-over valve 2 for switching a direction for the center rod to move, and a restarting hydraulic circuit 3 which, when a supply of the driving fluid from the change-over valve 2 to the driving chambers 11*b* and 12*b* in both sides is stopped, detects the supply of the driving fluid into the driving chambers 11*b* and 12*b* in both sides having been stopped and then causes the driving fluid to flow into the change-over valve, thereby restarting the supply of the driving fluid into the driving chambers 11*b* and 12*b*.

14 Claims, 7 Drawing Sheets

RESTARTING DEVICE FOR A FLUID OPERATED DOUBLE DIAPHRAGM PISTON PUMP

BACKGROUND OF THE INVENTION

The present invention relates to a restarting device of a pump for automatically restarting an operation of the pump in such an event in which the operation of the pump is shut down due to a change-over valve stopping in an intermediate position, where such a valve is to be moved back and forth to switch a direction of movement of a center rod of the pump.

Some pumps, such as diaphragm-type pumps according to the prior art, for example, have employed such a configuration in which the pump comprises a center rod provided with diaphragms in both sides thereof for defining fluid delivering chambers and driving chambers, respectively. In such a pump, when the center rod is to be driven toward one side, a driving fluid (e.g., a compressed air) is supplied into the driving chamber located in one side of the center rod so as to discharge a fluid-in-transfer in the fluid delivering chamber located in that one side. The fluid-in-transfer is suctioned into the fluid delivering chamber located in the other side of the center rod while the driving fluid in the driving chamber located in the other side is discharged. When the center rod is to be driven toward the other side, the driving fluid is supplied into the driving chamber located in the other side of the center rod so as to discharge the fluid-in-transfer in the fluid delivering chamber located in the other side. The fluid-in-transfer is suctioned into the fluid delivering chamber located in the one side of the center rod while the driving fluid in the driving chamber located in the one side is discharged, so that the fluid-in-transfer may be transferred continuously by this reciprocating motion of the center rod.

The diaphragm-type pump is provided with a change-over valve which moves back and forth in order to switch a direction of movement of the center rod. Such a change-over valve has a spool. The spool is provided with a pair of pressure chambers each being disposed on each side of the spool along its direction of movement for switching the direction of movement of the spool. In the change-over valve, a differential pressure is generated between each of the pressure chambers at the terminal end of the moving stroke of the center rod so as to switch a position of the spool.

However, if the liquid prepared as the fluid-in-transfer includes air in it, the operation of the diaphragm may possibly become unstable so as to stop the spool of the change-over valve in an intermediate position along the direction of its reciprocating motion.

Further, in a case where there is an insufficient supply of the driving fluid, the differential pressure between each pair of the pressure chambers will decrease, and there will be a shortage of energy to move the spool, which thereby results in the spool stopping in an intermediate position along the direction of its reciprocating motion.

Further, in a case where a compressed air is used as the driving fluid, when the compressed air to be supplied to the change-over valve is delivered into the change-over valve, the pressure of the compressed air might possibly drop rapidly and cause a low temperature in the change-over valve by adiabatic expansion so as to lead to a partially frozen condition thereof, which thereby results in the spool stopping in an intermediate position along the direction of its reciprocating motion.

If the spool stops in the intermediate position, supply of the driving fluid to the driving chamber is stopped, and thus the operation of the pump is shut down. To solve this problem, an inventive attempt has been undertaken, in which a snap spring is attached to one end portion of the spool so that a bias force of the snap spring may be used to prevent, to the utmost possible, the spool from stopping in the intermediate position. However, there is still a possibility that the spool might stop its movement in an intermediate position along its reciprocating motion.

SUMMARY OF THE INVENTION

The present invention has been made in the light of the above problems, and an object of the present invention is to provide a restarting device of a pump for automatically restarting an operation of the pump in such an event where the operation of the pump is shut down due to a change-over valve stopping in an intermediate position, which valve is to be moved back and forth to switch a direction for a center rod of the pump to move.

According to a first aspect of the present invention, there is provided a restarting device of a pump in which the pump comprises a center rod having first and second fluid delivering chambers and first and second driving chambers defined at first and second sides thereof, respectively. When the center rod is driven in a first direction, a driving fluid is supplied into the first driving chamber so as to discharge a fluid-in-transfer in the first delivering chamber, and the fluid-in-transfer is suctioned into the second fluid delivering chamber while the driving fluid in the second driving chamber is discharged therefrom. Further, when the center rod is driven in a second direction opposite to the first direction, the driving fluid is supplied into the second driving chamber so as to discharge the fluid-in-transfer in the second fluid delivering chamber, and the fluid-in-transfer is suctioned into the first fluid delivering chamber while the driving fluid in the first driving chamber is discharged therefrom. As a result, the fluid-in-transfer may be continuously transferred by the center rod reciprocating in the first and second directions. The restarting device of the pump comprises: a change-over valve for switching a direction of movement of the center rod; and a restarting hydraulic circuit, wherein when a supply of the driving fluid from the change-over valve to the first and second driving chambers is stopped, the restarting hydraulic circuit detects the supply of the driving fluid in the first and second driving chambers having been stopped, and then causes the driving fluid to flow into the change-over valve, which thereby restarts the supply of the driving fluid into the first and second driving chambers.

According to a second aspect of the present invention, there is provided a restarting device of a diaphragm-type pump in which the diaphragm-type pump comprises a center rod provided with a first and second diaphragm each on opposite sides of the center rod. The first diaphragm defines a first fluid delivering chamber and a first driving chamber, and the second diaphragm defines a second fluid delivering chamber and a second driving chamber. When the center rod is driven in a first direction, a driving fluid is supplied into the first driving chamber so as to discharge a fluid-in-transfer in the first fluid delivering chamber, and the fluid-in-transfer is suctioned into the second fluid delivering chamber while the driving fluid in the second driving chamber is discharged therefrom. Or, when the center rod is driven in a second direction opposite to the first direction, the driving fluid is supplied into the second driving chamber so as to discharge the fluid-in-transfer in the second fluid delivering chamber, and the fluid-in-transfer is suctioned into the first delivering chamber while the driving fluid in the first driving chamber is discharged therefrom. As a result, the fluid-in-transfer may be continuously transferred by the reciprocating motion of center rod in the first and second directions. The restarting device of the diaphragm-type pump comprises: a change-over valve for switching the direction of movement of the center; and a restarting hydraulic circuit, wherein when a supply of the driving fluid from said change-over valve to the first and second driving chambers is stopped, the restarting hydraulic circuit detects whether the supply of the driving fluid in the first and second driving chambers has been stopped, and then causes the driving fluid to flow into said change-over valve, thereby restarting the supply of the driving fluid into the first and second driving chambers.

According to a third aspect of the present invention, there is provided a restarting device of a diaphragm-type pump in which said change-over valve has a spool having a direction of movement, and first and second pressure chambers are arranged along opposite ends of the direction of movement of the spool. The driving fluid is supplied respectively to the first and second pressure chambers to switch the direction of movement of the spool, wherein when the center rod reaches a terminal end of its moving stroke, a pressure difference is generated between the respective pressures of the first and second pressure chambers so as to switch a position of said spool.

According to a fourth aspect of the present invention, there is provided a restarting device of a pump in which the first and second pressure chambers are in communication with the first and second driving chambers via pilot valves, respectively. Further, when the center rod is to move in the first direction or the second direction, the position of the spool is switched in such a way that when the center rod reaches the terminal end of its moving stroke, the driving fluid in one of the pressure chambers in communication with its respective driving chamber having a decreased volume is discharged into its respective driving chamber so as to decrease the pressure in that one pressure chamber.

According to a fifth aspect of the present invention, there is provided a restarting device of a pump in which said restarting hydraulic circuit comprises: a three-way check valve unit for detecting a stopped supply of the driving fluid into the first and second driving chambers, a check valve unit, and a normally-closed valve unit for releasing the driving fluid from one of the first or second pressure chambers into the atmosphere. The three-way check valve unit has two suction ports and a discharge port. The check valve unit has a suction port and a discharge port. The normally-closed valve unit has an input port, a suction port and an output port. Each of the suction ports of the three-way check valve unit is in communication with the first and second driving chambers, respectively. The discharge port of the three-way check valve unit is in communication with the suction port of the check valve unit. The discharge port of the check valve unit is in communication with the input port of the normally-closed valve unit. The suction port of the normally-closed valve unit is in communication with one of the first or second pressure chambers, and the output port of the normally-closed valve unit is open to the atmosphere. The restarting device is characterized by the following. When the spool is in a reciprocating motion, the suction port and the output port of the normally-closed valve unit are isolated from each other by a pilot pressure, which is generated by supplying the driving fluid from the three-way check valve unit to the check valve unit so as to be applied to the input port of the normally-closed value unit. Further, when the spool operationally stops at an intermediate position along its direction of movement, the suction port and the output port of the normally-closed valve unit are brought into communication with each other due to a decrease of the pilot pressure caused by the driving fluid being released into an atmosphere via the three-way check valve unit and the check valve unit. As a result, the driving fluid is supplied to one of the first or second pressure chambers through the suction port and the output port of the normally-closed valve unit, so that a pressure difference is generated between the respective pressures of the first and second pressure chambers, thereby allowing the spool to move from the intermediate position where said spool has stopped.

According to a sixth aspect of the present invention, there is provided a restarting device of a diaphragm-type pump in which the restarting hydraulic circuit is incorporated in an interior of a main body of the diaphragm-type pump.

According to a seventh aspect of the present invention, there is provided a restarting device of a diaphragm-type pump in which the first and second pressure chambers are in communication with the first and second driving chambers, respectively, and when the center rod is to move in the first direction or the second direction, the position of the spool is switched in such a way that when the center rod reaches the terminal end of its moving stroke, the driving fluid is supplied in one of the pressure chambers in communication with one of the driving chambers which is different from the driving chamber not having a decreased volume in order to reduce the pressure in the other pressure chamber.

According to an eighth aspect of the present invention, there is provided a restarting device of a pump in which the driving fluid is a compressed air.

DETAILED DESCRIPTION OF THE INVENTION

Figure 1:
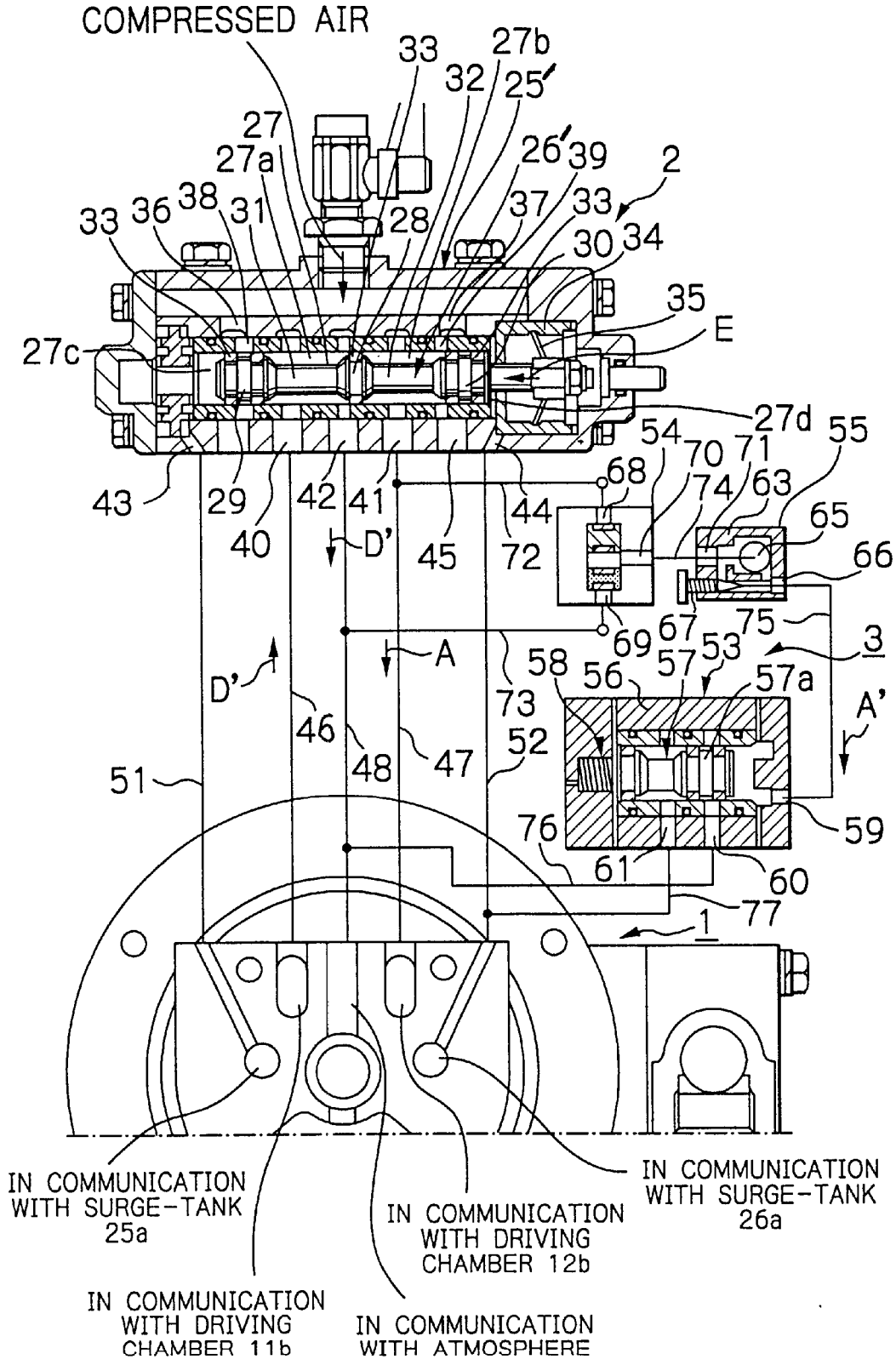
FIG. 1 is a schematic circuit diagram of the main components of a restarting device of a pump according to the present invention.

FIG. 1 is a schematic diagram of a hydraulic circuit of a restarting device of a diaphragm-type pump according to the present invention, in which reference numeral 1 designates a main body of the diaphragm-type pump, reference numeral 2 designates a change-over valve, and reference numeral 3 designates a restarting hydraulic circuit.

Figure 2:
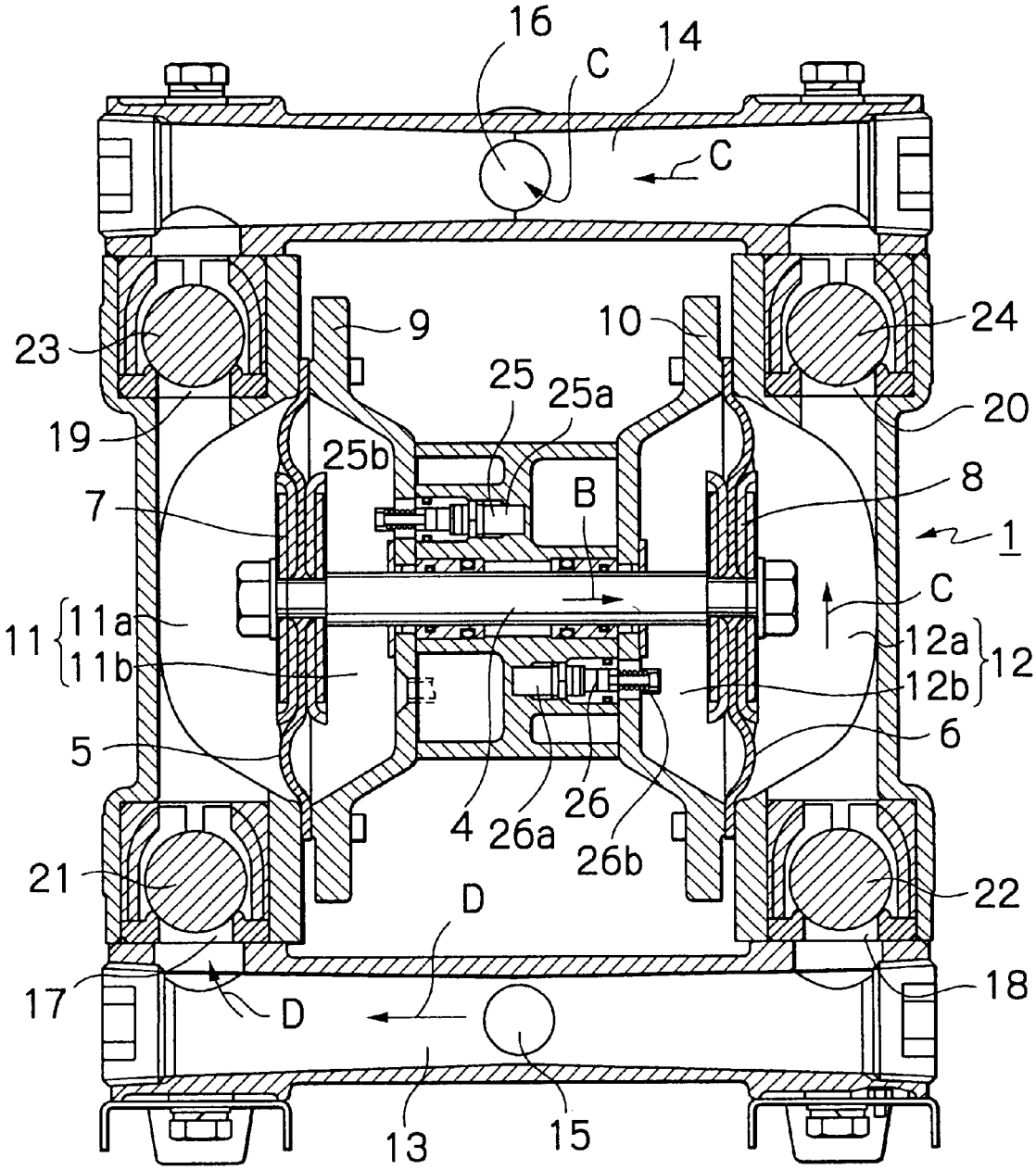
FIG. 2 is a cross sectional view illustrating an internal configuration of the pump of a diaphragm-type pump as shown in FIG. 1.

The main body 1 includes, as shown in FIG. 2, a center rod 4 arranged in the center thereof so as to move back and forth in the horizontal direction. A diaphragm 5 is arranged on one end of the center rod 4, and a diaphragm 6 is arranged on the other end of the center rod 4.

Diaphragms 5 and 6 are secured at center portions thereof to end portions of the center rod 4 by center discs 7 and 8, and diaphragms 5 and 6 are secured at peripheral portions thereof to mounting portions 9 and 10 of the main body 1, respectively.

There are spaces 11 and 12 in both of the sides of the center rod 4 along its direction of movement so as to permit the center rod 4 to move. Space 11 is segmented into a fluid delivering chamber 11*a* and a driving chamber 11*b* by the diaphragm 5, and space 12 is segmented into a fluid delivering chamber 12*a* and a driving chamber 12*b* by the diaphragm 6.

A supply path 13 is arranged in a lower portion of the main body 1 for supplying liquid-in-transfer to the fluid delivering chambers 11*a* and 12*a*. A discharging path 14 is arranged in an upper portion of the main body 1 for discharging the liquid-in-transfer in the delivering chambers 11*a* and 12*a* toward the outside of the main body 1. Reference numeral 15 designates an inlet port for receiving the liquid-in-transfer into the supply path 13 from an external unit, and reference numeral 16 designates a discharge port for discharging the liquid-in-transfer from the discharge path 14 to the outside of the main body 1.

Suction ports 17 and 18 are in communication with the supply path 13 and are arranged in lower portions of the fluid delivering chambers 11*a* and 12*a*, respectively, while discharge ports 19 and 20 are in communication with the discharge path 14 and are arranged in upper portions of the fluid delivering chambers 11*a* and 12*a*, respectively. The ports 17 to 20 are provided with respective ball valves 21 to 24 which serve as check valves for opening and closing the ports 17 to 20.

The main body 1 is provided with pilot valves 25 and 26 facing toward the driving chambers 11*b* and 12*b*, respectively. The driving chambers 11*b* and 12*b* are to be supplied with compressed air as a driving fluid from the change-over valve 2, which will be described in detail below.

The change-over valve 2 has a function for switching the direction of movement of the center rod 4. A spool valve has been employed for the change-over valve 2 in this embodiment. As shown in FIG. 1, the change-over valve 2 has a casing section 25 and a spool 26. The casing section 25 includes an accommodation space 27 for allowing the reciprocating motion of the spool 26 along a horizontal direction.

The spool 26 has a diameter-expanded section 28 in a central portion thereof, and the accommodation space 27 is divided by the diameter-expanded section 28 into a left chamber 27*a* and a right chamber 27*b*. Other diameter-expanded sections 29 and 30 are formed on the opposite sides of the spool 26 with a portion between the diameter-expanded sections 28 and 29 defined as a diameter-reduced section 31 and another portion between the diameter-expanded sections 28 and 30 defined as a diameter reduced section 32. Each of the diameter-expanded sections 28 to 30 is provided with a seal member 33.

The left chamber 27*a* has a pressure chamber 27*c*, and a back face of the diameter-expanded section 29 faces the pressure chamber 27*c*. The right chamber 27*a* has a pressure chamber 27*d*, and a back face of the diameter-expanded section 30 faces the pressure chamber 27*d*. A small amount of compressed air is supplied to those pressure chambers 27*c* and 27*d*, respectively, through small holes (not shown).

A snap spring mounting member 34 is arranged in one end portion of the casing section 25, and a snap spring 35 is mounted between one end portion of the spool 26 and the snap spring mounting member 34.

Air supply ports 36 and 37 are arranged in an upper portion of the casing section 25 for supplying compressed air as a diaphragm driving fluid. The left chamber 27*a* is provided with a port 38, and the right chamber 27*b* is provided with a port 39. The air supply port 36 is in communication with the port 38, and the air supply port 37 is in communication with the port 39. The port 38 is formed in such a location that the port 38 may be closed by the diameter-expanded section 29 when the spool 26 is positioned in the right hand side, and the port 39 is formed in such a location that the port 39 may be closed by the diameter-expanded section 30 when the spool 26 is positioned in the left hand side.

The left chamber 27*a* is provided with a port 40, the right chamber 27*b* is provided with a port 41, and an exhaust port 42 is formed in the casing section 25 at an intermediate location between the left chamber 27*a* and the right chamber 27*b*. The diameter-expanded section 28 is allowed to move back and forth across the exhaust port 42. The port 40 is brought into communication with the exhaust port 42 when the spool 26 is positioned in the right hand side and the port 41 is brought into communication with the exhaust port 42 when the spool 26 is positioned in the left hand side.

The pressure chamber 27*c* is provided with a port 43, and the pressure chamber 27*d* is provided with a port 44. A port 45 is arranged in the casing section 25 between the ports 41 and 44 so as to form a part of a restarting hydraulic circuit 3.

The port 40 is in communication with the driving chamber 11*b* via a connecting pipe 46, the port 41 is in communication with the driving chamber 12*b* via a connecting pipe 47, and the exhaust port 42 is in communication with the atmosphere via an exhaust pipe 48.

As shown in FIG. 2, the pilot valves 25 and 26 have surge-tanks 25*a* and 26*a*, respectively. As shown in FIG. 1, the port 43 is in communication with the surge-tank 25*a* of the pilot valve 25 via a connecting pipe 51, and the port 44 is in communication with the surge-tank 26*a* of the pilot valve 26 via a connecting pipe 52. The surge-tanks 25*a* and 26*a* serve to charge the compressed air supplied into the pressure chambers 27*c* and 27*d*, respectively. The pilot valves 25 and 26 have respective normally-closed-valve elements 25*b* and 26*b*. Tip portions of the normally-closed-valve elements 25*b* and 26*b* are facing the center discs 7 and 8, respectively, so as to allow for coming into contact with the center discs 7 and 8.

The restarting hydraulic circuit 3, when it detects that the supply of the driving fluid from the change-over valve 2 into both of the driving chambers 11*b* and 12*b* has been stopped, works to cause the driving fluid to circulate into the change-over valve 2, and thus works to restart the supply of the driving fluid into the driving chambers.

The restarting hydraulic circuit 3 includes a normally-closed valve unit (NC valve) 53, a three-way check valve unit 54, and a check valve unit 55. The normally-closed valve unit 53, as shown in the enlarged views of FIGS. 3 and 4, comprises a movable valve element 57 and a bias spring 58 arranged within a casing portion 56. The casing portion 56 has an input port 59 to which pilot pressure is input thereto, a suction port 60 for suctioning compressed air, and an output port 61 from which the compressed air is output therefrom. The movable valve element 57 has a diameter-expanded section 57*a*. The diameter-expanded section 57*a* serves so as to block a communication between the suction port 60 and the output port 61, and the bias spring 58 serves so as to bias the movable valve element 57 in a direction against the direction of the pilot pressure.

Figure 3:
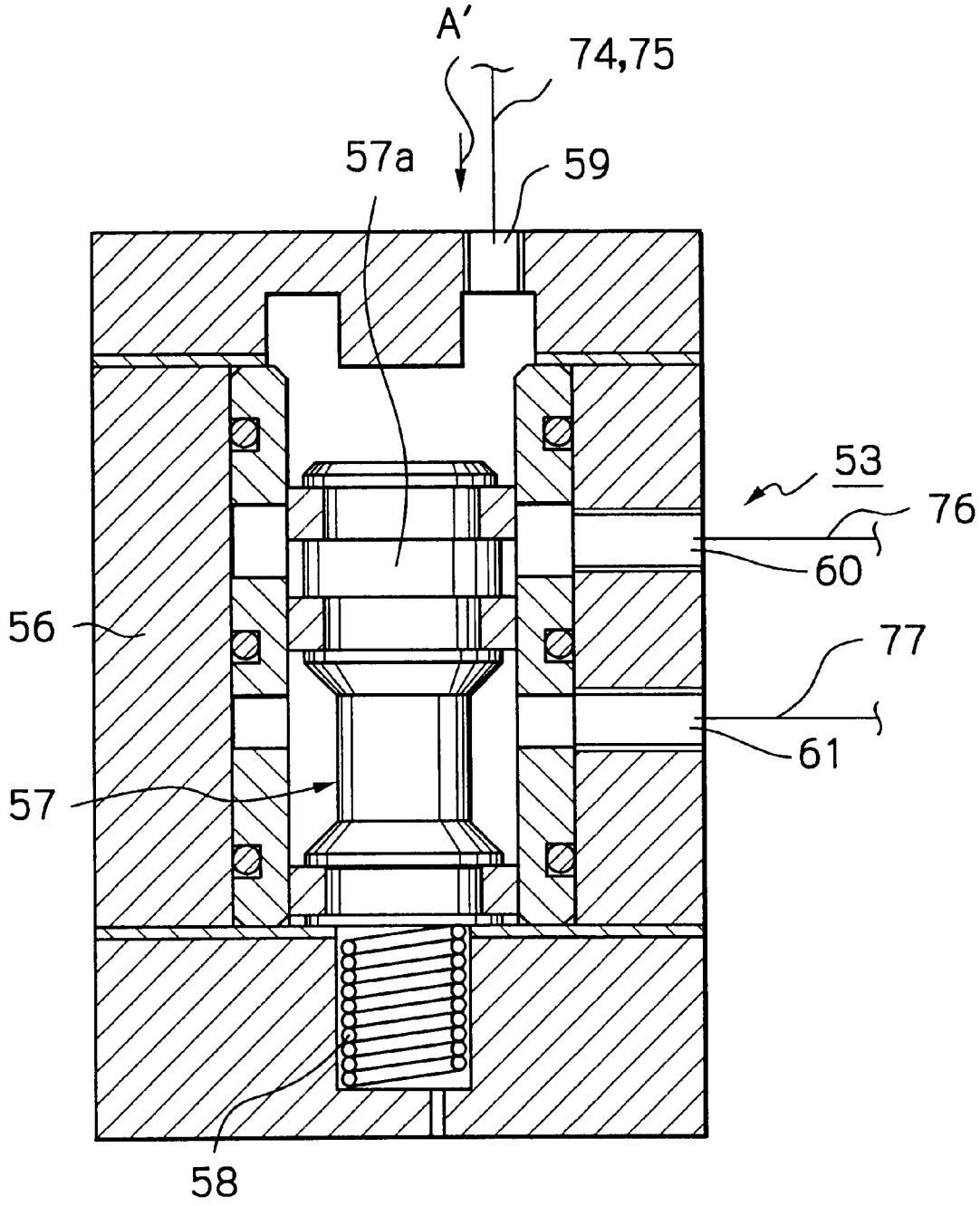
FIG. 3 is an enlarged cross-sectional view of an internal configuration of the normally-closed valve unit shown in FIG. 1, and illustrates a condition where a communication between a suction port and a discharge port is blocked.
Figure 4:
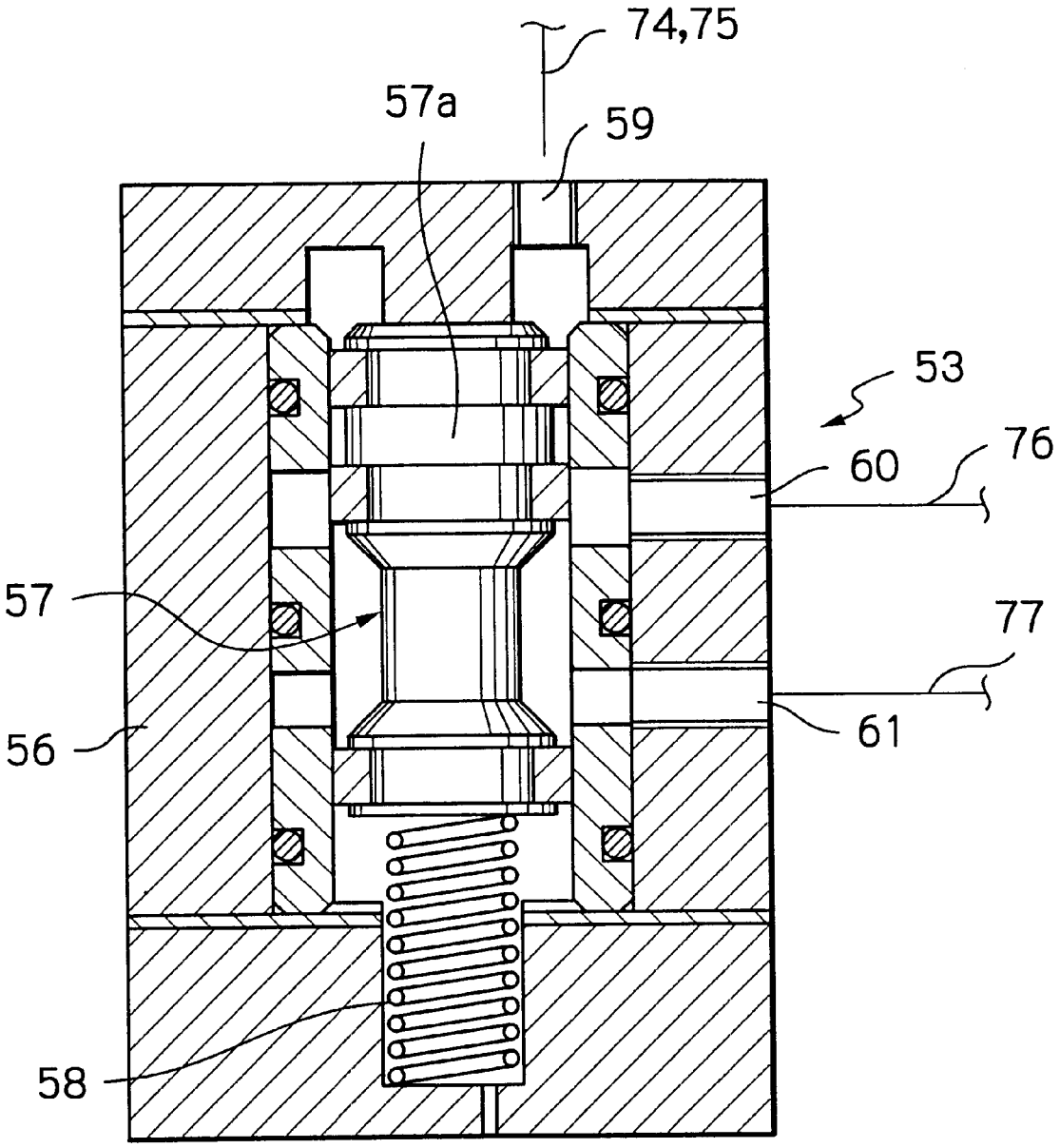
FIG. 4 is an enlarged cross-sectional view of an internal configuration of the normally-closed valve unit shown in FIG. 1, and illustrates a condition where the suction port and the discharge port are in communication with each other.

The bias spring 58 is compressed as shown in FIG. 3 when the pilot pressure is input through the input port 59, and the movable valve element 57 is positioned in a location where the suction port 60 is not allowed to communicate with the output port 61. However, when there is the pilot pressure is no longer being input, the movable valve element 57 will be moved by a biasing force from the bias spring 58, as shown in FIG. 4, to a location where the suction port 60 and the output port 61 are in communication with each other.

The three-way check valve unit 54 has two suction ports 68 and 69 and a discharge port 70. The check valve unit 55 has a suction port 71 and a discharge port 66. The discharge port 66 is in communication with the input port 59 of the normally-closed valve unit 53. The inlet port 59 of the normally-closed valve unit 53 is in communication with either one of the pressure chambers 27*c* and 27*d*.

Figure 7:
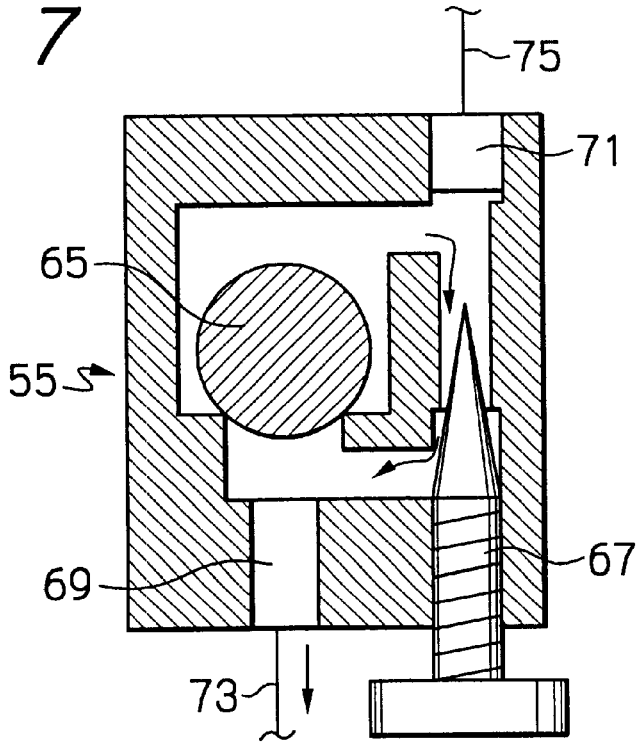
FIG. 7 is an enlarged view of the check valve unit as shown in FIG. 1, where the suction port is in communication with the left chamber of the check valve unit.
Figure 8:
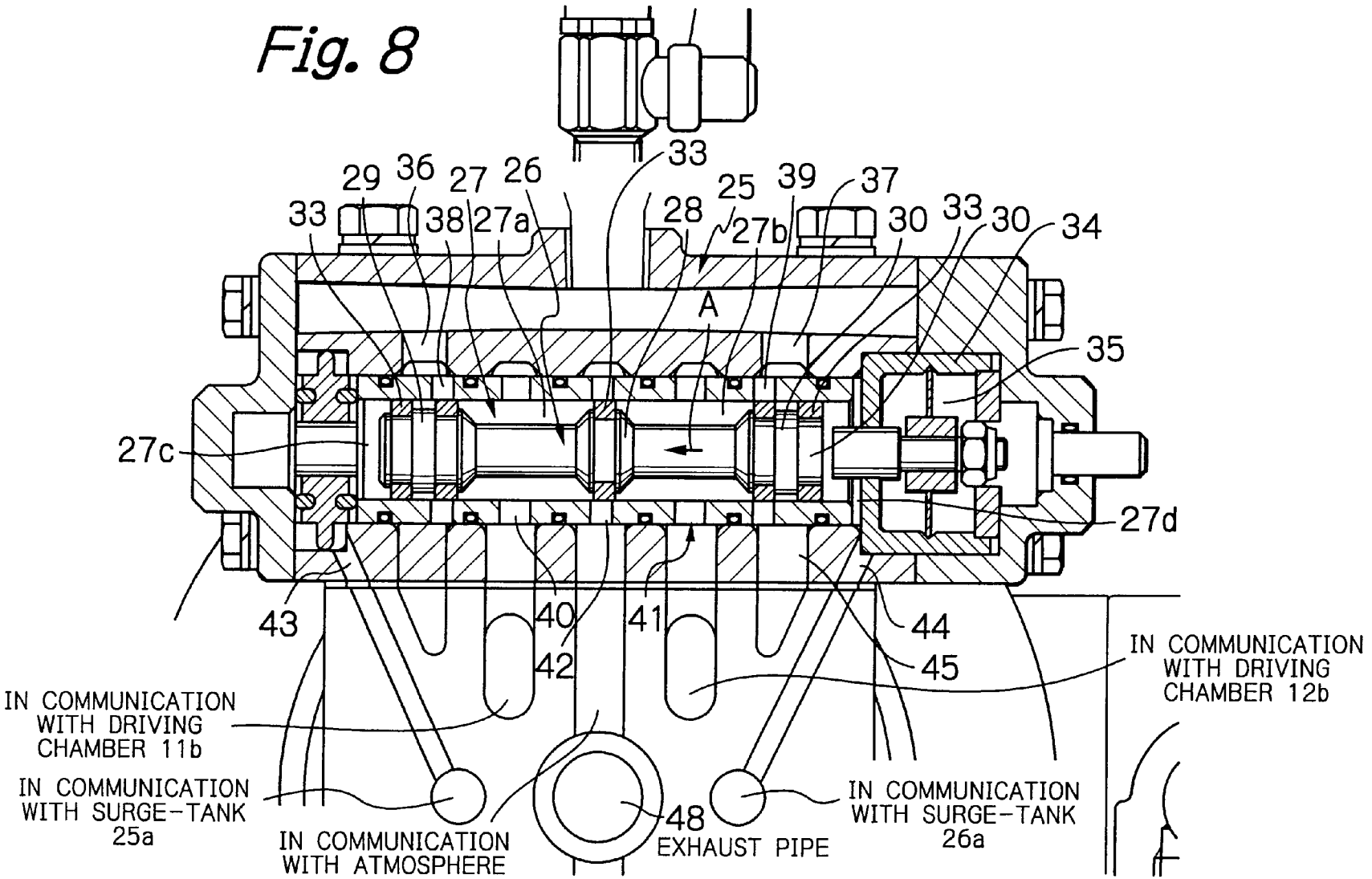
FIG. 8 is an enlarged view of the change-over valve, and illustrates the spool as shown in FIG. 1 stopping in an intermediate position.

The three-way check valve unit 54 serves to detect whether a supply of the driving fluid to the driving chamber 12*b* has been stopped, and the check valve unit 55 serves to detect whether a supply of the driving fluid to the driving chamber 11*b* has been stopped. Within a casing portion 63, the check valve unit 55 includes, as shown in FIGS. 1 and 7, a ball valve 65, which functions as a check valve, and a needle valve 67, which functions as a throttle valve. The ball valve 65 serves to open or close the suction port 71. The casing portion 63 of the check valve unit 55 is provided with a discharge port 66. The needle valve 67 serves to discharge the compressed air in the discharge port 66 side of the check valve unit 55 into the atmosphere little by little.

As shown in FIG. 1, the suction port 68 of the three-way check valve unit 54 is in communication with the connecting pipe 47 via a branch pipe 72, and the suction port 69 is in communication with the exhaust pipe 48 via a branch pipe 73. The discharge port 70 of the three-way check valve unit 54 is connected to the input port 59 of the normally-closed valve unit 53 via a connecting pipe 74.

The suction port 60 of the normally-closed valve unit 53 is connected to the exhaust port 42 via a compressed air supply pipe 76, and the output port 61 of the normally-closed valve unit 53 is connected to the connecting pipe 52 via a branch pipe 77.

Figure 5:
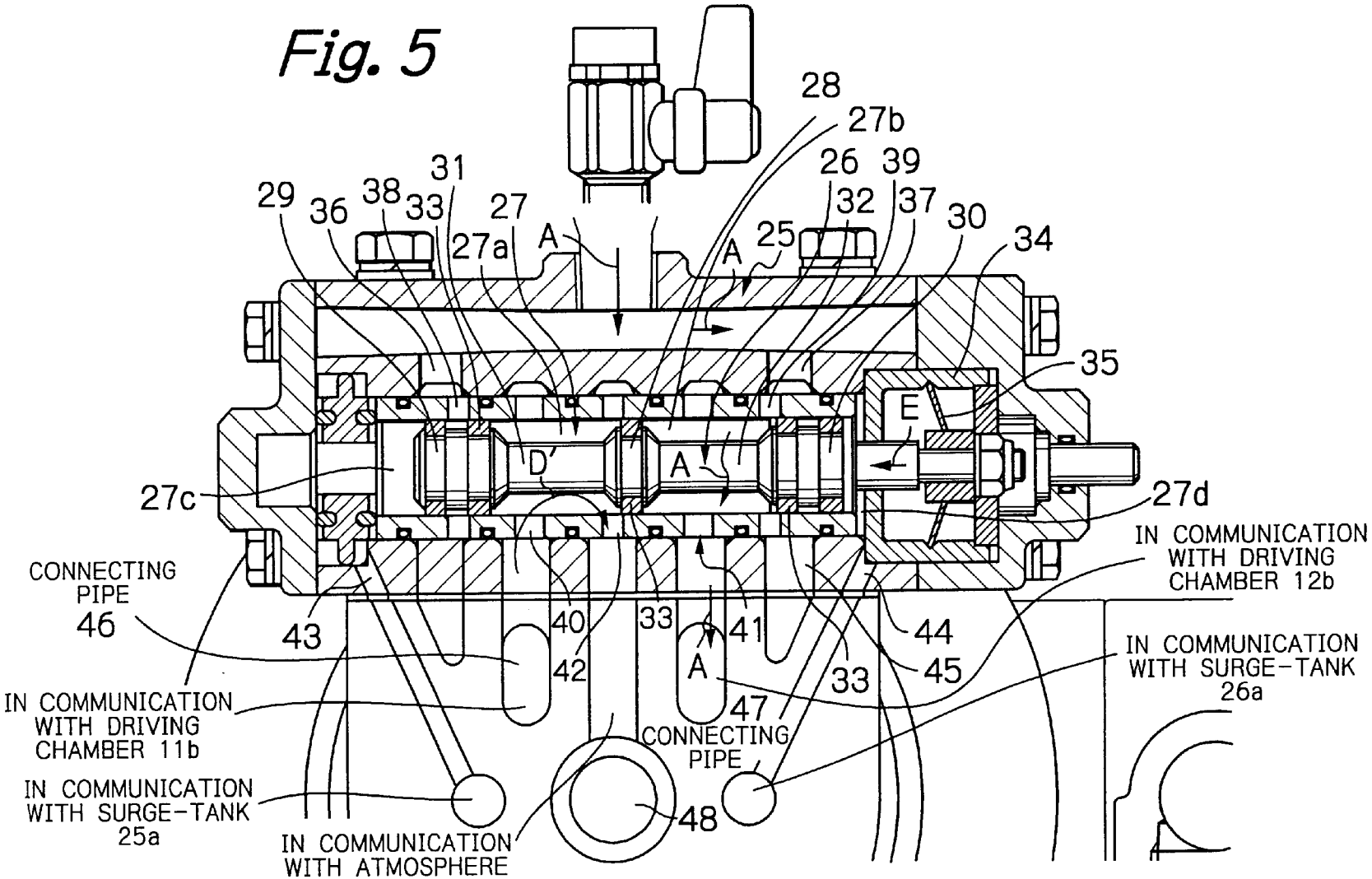
FIG. 5 is an enlarged view of a change-over valve, and illustrates a condition where a spool as shown in FIG. 1 is positioned in the right hand side.
Figure 6:
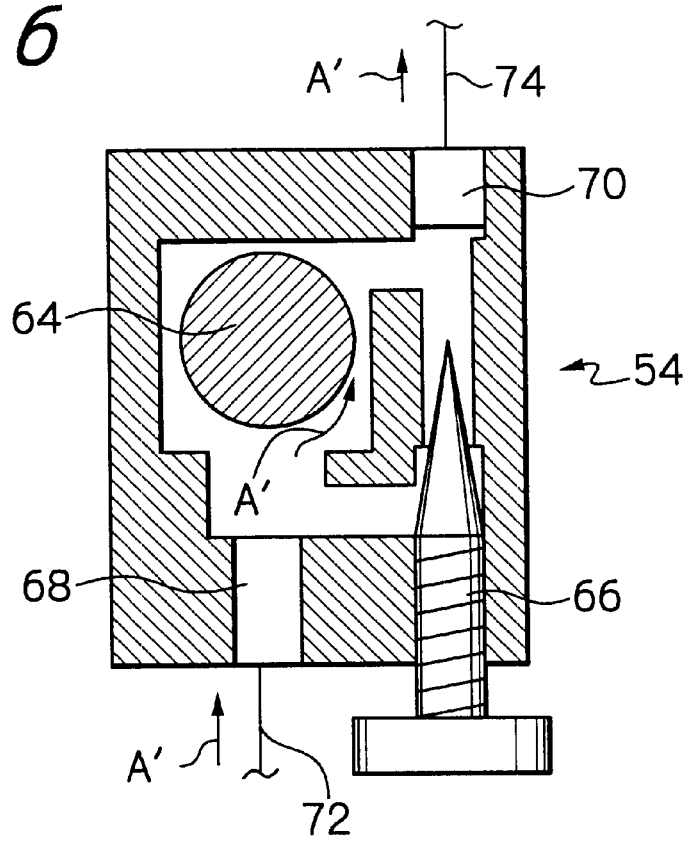
FIG. 6 is an enlarged view of a check valve unit as shown in FIG. 1, where a suction port is in communication with the right chamber of the check valve unit.

FIG. 1 shows a condition where the spool 26 is positioned in the right hand side, where the port 40 and the exhaust port 42 are in communication with each other, and where the port 39 is open. Accordingly, the compressed air is supplied into the driving chamber 12*b* via the ports 39 and 41 and the connecting pipe 47 as shown in the enlarged view of FIG. 5 along the path as indicated by the arrow A, and the diaphragm 6 is thereby expanded to drive the center rod 4 to move in the direction as indicated by the arrow B in FIG. 2.

As the diaphragm 6 is expanded to reduce the volume of the fluid delivering chamber 12*a*, the fluid-in-transfer in the fluid delivering chamber 12*a* is flown in the direction indicated by the arrow C of FIG. 2 to be discharged to the outside of the main body 1 through the discharge port 16.

Further, as the center rod 4 is moved in the direction indicated by the arrow B to reduce the volume of the driving chamber 11*b*, the compressed air in the driving chamber 11*b* is discharged into the atmosphere as indicated by the arrow D' via the connecting pipe 46, the port 40, the exhaust port 42 and the exhaust pipe 48. At the same time, as the extended volume of the fluid delivering chamber 11*a* generates a negative pressure within the fluid delivering chamber 11*a*, the fluid-in-transfer is drown along the path indicated by the arrow D via the inlet port 15 and the suction port 17, and the fluid delivering chamber 11*a* is thereby filled up with the fluid-in-transfer.

During a series of these operations, since the compressed air is made to flow into the suction port 68 of the three-way check valve unit 54 as indicated by the arrow A' via the port 41 and the branch pipe 72, the compressed air in the three-way check valve unit 54 is supplied to the input port 59 of the normally-closed valve unit 53 via the discharge port 70 and the connecting pipe 74. As a result, the movable valve element 57 of the normally-closed valve unit 53 is held in the condition where it blocks communication between the suction port 60 and the output port 61.

On the other hand, during the series of these operations, since the compressed air in the driving chamber 11*b* is discharged into the atmosphere via the port 40, the exhaust port 42 and the exhaust pipe 48, the pressure of the compressed air within the branch pipe 73 drops. Consequently, the suction port 69 of the check valve unit 55 is closed by the ball valve 65 as shown in the enlarged view of FIG. 7, which thereby prevents the compressed air of the pilot pressure input into the input port 59 of the normally-closed valve unit 53 via the port 41, the branch pipe 72, the three-way check valve unit 54 and the connecting pipe 74 from flowing into the branch pipe 73 via the check valve unit 55.

As the center rod 4 is further driven in the direction as indicated by the arrow B to bring the center disc 7 into contact with the normally-closed valve element 25*b* of the pilot valve 25 and the center rod 4 reaches the terminal end of its moving stroke, the compressed air within the surge-tank 25*a* is discharged into the driving chamber 11*b* to generate a pressure difference between the pressure within the pressure chamber 27*c* and the pressure within the pressure chamber 27*d*. As a result of this pressure difference, the spool 26 is thereby affected by the biasing force of the snap spring 35 to move immediately in the direction indicated by the arrow E, which thus allows the driving direction of the center rod 4 to be switched.

That is, the position of the spool 26 is switched in such a way that when the center rod reaches the terminal end of its moving stroke, the driving fluid in the pressure chamber in communication with the driving chamber having the decreased volume is discharged into the driving chamber so as to drop the pressure in that pressure chamber.

Accordingly, the port 39 of the right chamber 27*b* is thereby closed, and as a result, the port 41 and the exhaust port 42 are then brought into communication with each other. On the other hand, when the port 38 of the left chamber 27*a* is open, the communication between the port 40 and the exhaust port 42 is blocked. Accordingly, the compressed air is fed into the driving chamber 11*b* through the port 40 via the connecting pipe 46, and the diaphragm 5 is thereby expanded so as to increase the volume of the driving chamber 11*b* while the volume of the fluid delivering chamber 11*a* is reduced as the fluid-in-transfer within the fluid delivering chamber 11*a* is discharged outside of the main body 1 through the discharge port 19 and the discharge path 14.

On the other hand, as the center rod 4 is moved in a direction opposite to the direction of the arrow B, the volume of the driving chamber 12*b* is reduced in order to increase the volume of the fluid delivering chamber 12*a*, and as a result, the fluid-in-transfer is thereby drawn into the fluid delivering chamber 12*a* through the inlet port 15 and the suction port 18 so that the fluid delivering chamber 12*a* is filled up with the fluid-in-transfer.

During a series of these operations, since the compressed air is fed into the suction port 69 via the exhaust port 42 and the branch pipe 73, the suction port 69 of the check valve unit 55 is open, and the compressed air therein is supplied to the input port 59 of the normally-closed valve unit 53 via the discharge port 71 and the connecting pipe 75. As a result, the movable valve element 57 of the normally-closed valve unit 53 is held in a condition where the communication between the suction port 60 and the output port 61 is blocked. On the other hand, during the series of these operations, since the compressed air in the driving chamber 12*b* is discharged into the atmosphere via the port 41, the exhaust port 42 and the exhaust pipe 48, the pressure of the compressed air within the branch pipe 72 decreases, and consequently, the suction port 68 of the check valve unit 54 is closed by the ball valve 64, which thereby prevents the compressed air of the pilot pressure input into the input port 59 of the normally-closed valve unit 53 via the port 40, the branch pipe 73, the check valve unit 55 and the connecting pipe 75 from flowing into the branch pipe 72 via the three-way check valve unit 54.

In a normal operation mode where the spool 26 of the change-over valve 2 would not stop in the intermediate position because the pilot pressure is assumed to be regularly applied to the input port 59 of the normally-closed valve unit 53, the communication between the suction port 60 and the output port 61 thereof is regularly blocked by the movable valve element 57, and the diaphragm-type pump repeats its normal operation as it has been.

However, assuming herein that the spool stops for some reason in the intermediate position when the port 38 is blocked by the diameter-expanded section 29, the port 39 is blocked by the diameter-expanded section 30, and the exhaust port 42 is blocked by the diameter-expanded section 28, the compressed air would not be supplied to the driving chamber 11*b* or 12*b* through either of the connecting pipes 46 or 47, which thereby results in the diaphragm-type pump stopping its operation.

Since the connecting pipes 47 and 46 are brought into communication with the suction ports 68 and 69 of the three-way check valve unit 54 via the branch pipes 72 and 73, respectively, and the needle valve 67 discharges the compressed air in the discharge port 66 side toward the atmosphere little by little, the pilot pressure applied to the input port 59 of the normally-closed valve unit 53 therefore decreases. As a result, the movable valve element 57 is driven from the position as shown in FIG. 3 toward the position as shown in FIG. 4 by the biasing force of the bias spring 58, thereby bringing the suction port 60 in communication with the output port 61 to allow the compressed air having been stored in the compressed air supply pipe 76 to be introduced into the pressure chamber 27*d* through the suction port 60, the output port 61, the branch pipe 77 and the connecting pipe 52. This generates a pressure difference between the respective pressures in the pressure chamber 27*c* and in the pressure chamber 27*d*. Such a pressure difference moves the spool 26 along the direction indicated by the arrow E, which causes the port 38 to be brought into communication with the port 40 and the port 41 to be brought into communication with the exhaust port 42.

Thereby, the condition is turned to be such that the compressed air is again supplied to the driving chamber 11*b* via the connecting pipe 46, while the compressed air is exhausted from the driving chamber 12*b* via the connecting pipe 47, thereby allowing the diaphragm-type pump to restart automatically.

It is to be noted that the needle valves 66 and 67 function to prevent a possible occurrence of the chattering phenomenon between the change-over valve 2 and the normally-closed valve unit 53.

In the foregoing embodiment of the present invention, the pressure difference is generated between the respective pressure in the pressure chamber 27*c* and in the pressure chamber 27*d* by decreasing the pressure of either one of the pressure chambers 27*c* or 27*d* to cause the spool to move. The present invention is also applicable to such a configuration in which either one of the pressure chambers 27*c* or 27*d* may have its pressure increased to cause the spool 26 to move.

In the foregoing embodiment, the present invention is applied to a diaphragm-type pump. However, the present invention can also be applied to an air-drive type piston pump or a bellows pump.

Moreover, in the foregoing embodiment of the present invention, the restarting hydraulic circuit 3 is arranged externally to the main body 1 of the diaphragm-type pump. However, the restarting hydraulic circuit 3 can also be arranged within the main body 1.

EFFECT OF THE INVENTION

According to the present invention, even if the operation of a pump stops due to a change-over valve stopping in an intermediate location, which has been moved back and forth to switch the movable direction of a center rod of the pump, the operation of the pump can be restarted automatically.

What is claimed is:

1. A restarting device of a pump in which said pump comprises a center rod having first and second delivering chambers and first and second driving chambers defined at first and second sides thereof, respectively, said center rod being operable to reciprocate in a first direction and a second direction opposite to the first direction so that a fluid-in-transfer is continuously transferred, wherein when said center rod is driven in the first direction, a driving fluid is supplied into said first driving chamber so as to discharge the fluid-in-transfer in said first fluid delivering chamber, and the fluid-in-transfer is suctioned into said second fluid delivering chamber while the driving fluid in said second driving chamber is discharged therefrom, and when said center rod is driven in the second direction, the driving fluid is supplied into said second driving chamber so as to discharge the fluid-in-transfer in said second fluid delivering chamber, and the fluid-in-transfer is suctioned into said first fluid delivering chamber while the driving fluid in said first driving chamber is discharged therefrom;

said restarting device of the pump comprising: a change-over valve for switching a direction of movement of said center rod, and for supplying the driving fluid into said first and second driving chambers; and a restarting hydraulic circuit, wherein when a supply of the driving fluid from said change-over valve to said first and second driving chambers is stopped, said restarting hydraulic circuit detects that the supply of the driving fluid into said first and second driving chambers has stopped, and then causes the driving fluid to flow into said change-over valve so as to restart the supply of the driving fluid into said first and second driving chambers.

2. A restarting device of a diaphragm-type pump in which said diaphragm-type pump comprises a center rod being operable to reciprocate in a first direction and a second direction opposite to the first direction so as to continually transfer a fluid-in-transfer, said center rod being provided with first and second diaphragms on opposite sides thereof, said first and second diaphragms defining first and second fluid delivering chambers and first and second fluid driving chambers, respectively, wherein when said center rod is driven in the first direction, a driving fluid is supplied into said first driving chamber so as to discharge the fluid-in-transfer in said first fluid delivering chamber, and the fluid-in-transfer is suctioned into said second fluid delivering chamber while the driving fluid in said second driving chamber is discharged therefrom, and when said center rod is driven in the second direction, the driving fluid is supplied into said second driving chamber so as to discharge the fluid-in-transfer in said second fluid delivering chamber, and the fluid-in-transfer is suctioned into said first fluid delivering chamber while the driving fluid in said first driving chamber is discharged therefrom;

said restarting device of the diaphragm-type pump comprising: a change-over valve for switching a direction of movement of said center rod, and for supplying the driving fluid into said first and second driving chambers; and a restarting hydraulic circuit, wherein when a supply of the driving fluid from said change-over valve to said first and second driving chambers is stopped, said restarting hydraulic circuit detects that the supply of the driving fluid into said first and second driving chambers has stopped, and then causes the driving fluid to flow into said change-over valve so as to restart the supply of the driving fluid into said first and second driving chambers.

3. A restarting device of a diaphragm-type pump in accordance with claim 2, in which said change-over valve has a spool, first and second pressure chambers are arranged at first and second sides along a direction of movement of said spool, respectively, and the driving fluid is supplied into said first and second pressure chambers to switch the direction of movement of said spool, wherein when said center rod reaches a terminal end of a moving stroke, a pressure difference is generated between respective pressures in said first and second pressure chambers so as to switch a position of said spool.

4. A restarting device of a diaphragm-type pump in accordance with claim 3, in which said first and second pressure chambers are in communication with said first and second driving chambers, respectively, via a pilot valve, wherein when the direction of movement of said center rod is to be switched, the position of said spool is switched in such a way that when said center rod reaches the terminal end of its moving stroke, the driving fluid in one of said pressure chambers in communication with its respective driving chamber having a decreased volume is discharged into said respective driving chamber so as to reduce the pressure in said one of said pressure chambers.

5. A restarting device of a diaphragm-type pump in accordance with claim 4, in which said restarting hydraulic circuit comprises a three-way check valve unit for detecting a stopped supply of the driving fluid supplied into said first and second driving chambers, a check valve unit, and a normally-closed valve unit for releasing the driving fluid from one of said pair of pressure chambers into the atmosphere, said three-way check valve unit having two suction ports and a discharge port, said check valve unit having a suction port and a discharge port, and said normally-closed valve unit having an input port, a suction port and an output port, wherein said suction ports of said three-way check valve unit are in communication with said first and second driving chambers, respectively, said discharge port of said three-way check valve unit is in communication with said suction port of said check valve unit, said discharge port of said check valve unit is in communication with said input port of said normally-closed valve unit, said suction port of said normally-closed valve unit is in communication with one of said first and second pressure chambers, and said output port of said normally-closed valve unit is open to the atmosphere, wherein said restarting device is characterized in that when said spool is in a reciprocating motion, said suction port and said output port of said normally-closed valve unit are isolated from each other by a pilot pressure, which is generated by supplying the driving fluid from said three-way check valve unit to said check valve unit and is applied to said input port of said normally-closed valve unit, and said restarting device is characterized in that when said spool operationally stops at an intermediate position along its direction of movement, said suction port and said output port of said normally-closed valve unit are brought into communication with each other due to a decrease of the pilot pressure caused by the driving fluid being discharged into an atmosphere chamber via said three-way check valve unit and said check valve unit, and the driving fluid in one of said first and second pressure chambers is released into the atmosphere through said suction port and said output port of said normally-closed valve unit so that a pressure difference is generated between respective pressures in said first and second pressure chambers, wherein the pressure difference allows said spool to move from said intermediate position where said spool has stopped.

6. A restarting device of a diaphragm-type pump in accordance with claim 5, in which said restarting hydraulic circuit is incorporated in an interior of a main body of said diaphragm-type pump.

7. A restarting device of a diaphragm-type pump in accordance with claim 3, in which said first and second pressure chambers are in communication with said first and second driving chambers, respectively, and when the direction of movement of said center rod is to be switched, the position of said spool is switched in such a way that when said center rod reaches the terminal end of its moving stroke, the driving fluid is supplied into one of said first and second pressure chambers in communication with one of said first and second driving chambers which is different from a driving chamber having a decreased volume so as to reduce the pressure in the other one of said first and second pressure chambers.

8. A restarting device of a pump in accordance with claim 1, in which said driving fluid is a compressed air.

9. A restarting device of a pump in accordance with claim 2, in which said driving fluid is a compressed air.

10. A restarting device of a pump in accordance with claim 3, in which said driving fluid is a compressed air.

11. A restarting device of a pump in accordance with claim 4, in which said driving fluid is a compressed air.

12. A restarting device of a pump in accordance with claim 5, in which said driving fluid is a compressed air.

13. A restarting device of a pump in accordance with claim 6, in which said driving fluid is a compressed air.

14. A restarting device of a pump in accordance with claim 7, in which said driving fluid is a compressed air.

* * * * *